US006723962B1

(12) United States Patent
Sit

(10) Patent No.: US 6,723,962 B1
(45) Date of Patent: Apr. 20, 2004

(54) DOUBLE DECK TOASTER OVEN

(75) Inventor: Antony Sit, Hong Kong (HK)

(73) Assignee: Sun Cupid Industries Ltd. (HK)

( * ) Notice: Subject to any disclaimer, the term of this patent is extended or adjusted under 35 U.S.C. 154(b) by 0 days.

(21) Appl. No.: 10/187,686

(22) Filed: Jul. 2, 2002

(51) Int. Cl.[7] ..... A21B 1/22

(52) U.S. Cl. ..... 219/404; 219/392; 219/396; 219/398; 219/411

(58) Field of Search ..... 219/409, 405, 219/411, 391, 404, 753, 681, 685, 756, 392, 396, 398

(56) References Cited

U.S. PATENT DOCUMENTS

| | | | | | |
|---|---|---|---|---|---|
| 3,899,655 | A | * | 8/1975 | Skinner | 219/404 |
| 4,629,850 | A | * | 12/1986 | Tanabe | 216/10.55 B |
| 5,548,102 | A | * | 8/1996 | Kwon | 219/685 |
| 5,747,781 | A | * | 5/1998 | Kim et al. | 219/685 |
| 5,793,023 | A | | 8/1998 | Hong et al. | 219/685 |
| 6,091,057 | A | | 7/2000 | Asami et al. | 219/404 |
| 6,242,716 | B1 | * | 6/2001 | Wang | 219/404 |

FOREIGN PATENT DOCUMENTS

| | | |
|---|---|---|
| DE | 2906875 | 9/1980 |
| DE | 19828641 | 12/1999 |
| EP | 0660646 | 6/1995 |
| EP | 0966180 | 12/1999 |
| EP | 1058483 | 12/2000 |
| FR | 2730796 | 8/1996 |
| GB | 2309620 | 7/1997 |
| JP | 234742 | 8/2000 |
| JP | 291960 | 10/2000 |

OTHER PUBLICATIONS

A Photocopy of the Toast & Bake Microwave Oven by Samsung Electronics America, Inc., taken from the Samsung website, www.samsungusa.com, (see Overview and note model No. MT1066SB).*

A press release from the Samsung website, www.samsungusa.com, dated Apr. 11, 2003 describing the Toast & Bake Microwave Oven.*

Business & Technology Editors, Article from "BUSINESS WIRE", dated Apr. 18, 2002, p. 1, (note date of article and model Nos. included in article.*

Beatty, Gerry, Article from HFN The Weekly Newspaper for the Home Furnishing Network, dated Apr. 22, 2002, p. 70, (note date of article).*

Photocopy of brochure of National Microwave Oven (Year of Publication: 2000 or 2001).

* cited by examiner

*Primary Examiner*—Shawntina Fuqua
(74) *Attorney, Agent, or Firm*—Raymond A. Nuzzo

(57) ABSTRACT

An oven having a cooking chamber which has a pair of opposing sidewalls and a rear wall member having a pair of end portions and a protruding portion between the end portions. First and second stationary heaters are located within lower and upper portions, respectively, of the cooking chamber and a pair of movable heaters located between the first and second stationary heaters. Each movable heater is movably attached to a corresponding one of the end portions of the rear wall member and movable between a resting position and a heating position. Each movable heater is adjacent to a corresponding sidewall when the movable heater is in the resting position. A manually operated mechanical drive system moves both movable heaters simultaneously between the resting position and the heating position. Rack support members are attached to the sidewalls for supporting a lower rack below the movable heaters and an upper rack above the movable heaters.

11 Claims, 4 Drawing Sheets

DOUBLE DECK TOASTER OVEN

BACKGROUND OF THE INVENTION

1. Field of the Invention

The present invention relates generally to electric ovens.

2. Description of the Related Art

Electric ovens having movable heating elements are known in the art. Such ovens are described in U.S. Pat. Nos. 5,793,023 and 6,091,057, German Patent No. 2906875, French Patent No. 2730796, European Patent Nos. 660646, 966180, 19828641, and 1058483, and Japanese Patent Nos. 291960 and 234742. Some of these ovens utilize electric motors or other electric components to move the heating elements. Ovens utilizing such electric motors and/or electric components are described in the aforementioned European Patent Nos. 966180 and 1058483, German Patent No. 19828641 and Japanese Patent No. 291960. However, the use of such electric motors and other electrical components to move the heater elements increases the manufacturing costs of the electric ovens and thereby increases the retail cost to consumers.

Thus, it is an object of the present invention to provide a new and improved electric oven that utilizes movable heaters and a manually operated mechanical drive system to move the movable heaters to desired positions.

Additional objects and advantages of the present invention are apparent from the drawings and specification which follow.

SUMMARY OF THE INVENTION

The present invention is directed to a double deck toaster oven. As used herein, the phrase "double deck" refers to an oven configuration that allows two racks to be arranged in a vertical orientation, one above the other, within the heating or cooking chamber of the oven so as to allow the food on both racks to cook simultaneously. Such a configuration is also referred to herein as a "double-rack" configuration. Thus, the phrases "double-rack" and "double deck" have the same meaning and are used interchangeably. For purposes of brevity, the term "oven" is used to refer to the double deck toaster oven of the present invention.

The oven of the present invention comprises a cooking chamber having a pair of opposing sidewalls and a rear wall member having a pair of end portions and a protruding portion between the end portions. The cooking chamber has lower and upper portions. The oven further comprises first and second stationary heaters located within the lower and upper portions, respectively, of the cooking chamber. The oven further comprises a pair of movable heaters located between the first and second stationary heaters. Each movable heater is movably attached to a corresponding one of the end portions of the rear wall member and movable between a resting position and a heating position. Each movable heater is adjacent to a corresponding sidewall when the movable heater is in the resting position. The oven further includes a manually operated mechanical drive system for moving both movable heaters simultaneously between the resting position and the heating position. The oven further includes a first pair of rack support members. Each rack support member is attached to a corresponding one of the opposed sidewalls so as to support a rack within the cooking chamber such that the rack is below the movable heaters. The oven further includes a second pair of rack support members. Each rack support member of the second pair is attached to a corresponding one of the opposed sidewalls so as to support an additional rack within the cooking chamber such that the additional rack is above the movable heaters.

The protruding portion of the rear wall member forms a portion of the cooking chamber. Due to the shape and configuration of the protruding portion of the rear wall member, the cooking chamber can accommodate relatively large sized food items. For example, when two racks are placed in the cooking chamber, one above the other, each rack can receive a twelve inch pizza.

A feature of the oven of the present invention is the use of a manually operated mechanical drive system to move the movable heaters between the resting and heating positions thereby eliminating the need for electrical motors or other electrical components to move the movable heaters.

Another feature of the oven of the present invention is that the oven may be quickly and easily converted between a normal, single-rack mode of operation and a double-rack mode of operation.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DETAILED DESCRIPTION OF THE PREFERRED EMBODIMENTS

Figure 1:
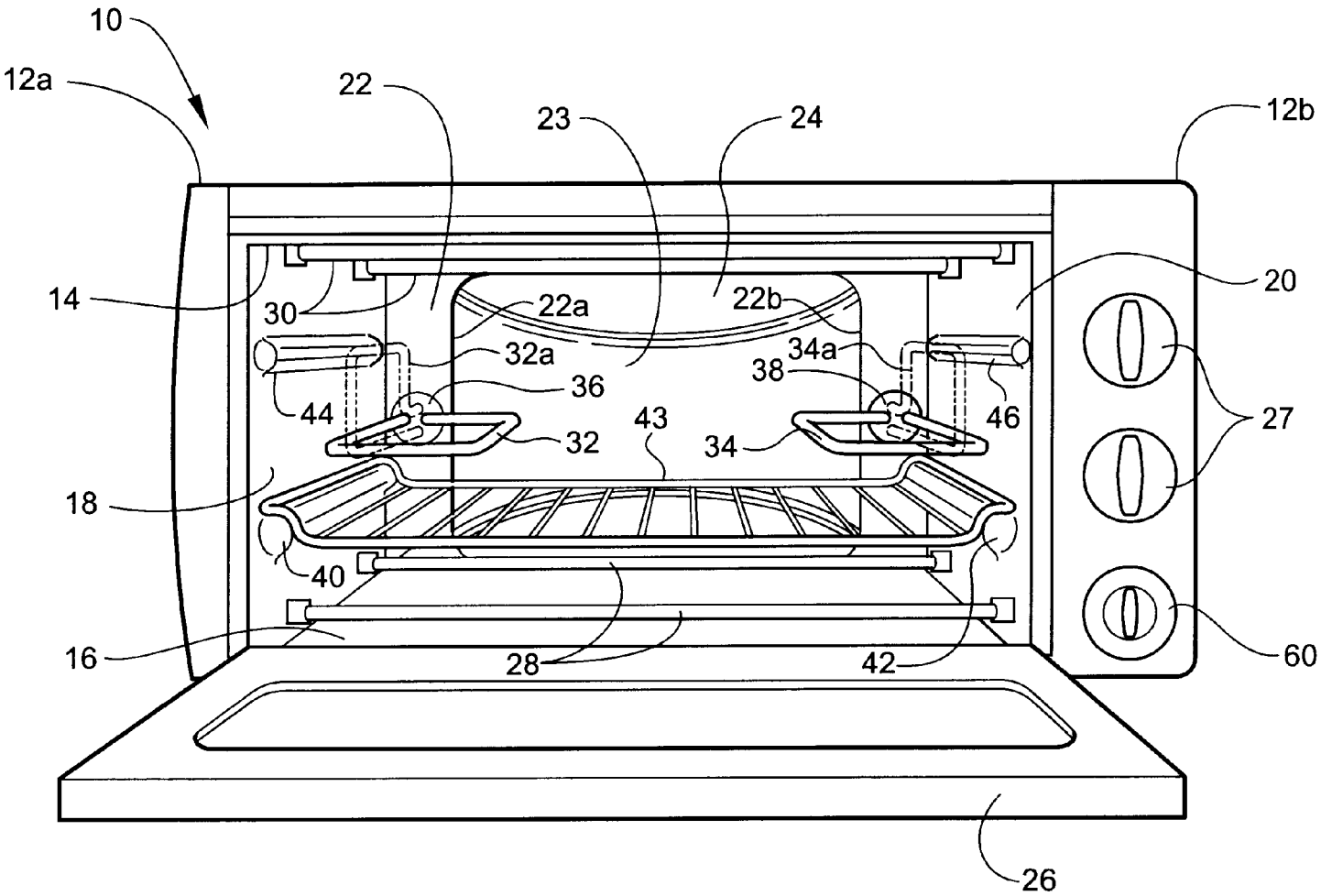
FIG. 1 is a front view of the oven of the present invention.
Figure 2:
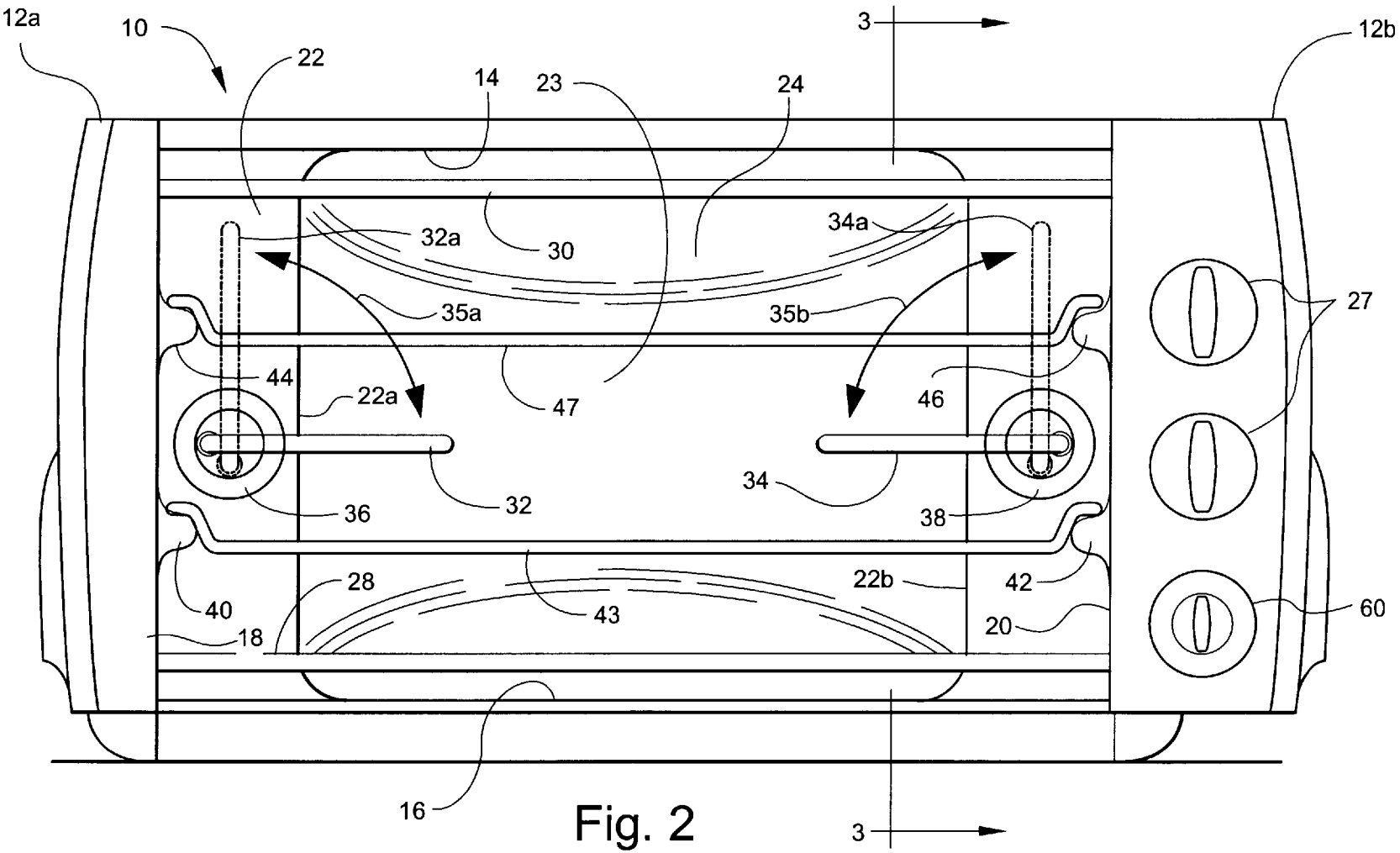
FIG. 2 is a front view of the oven of the present invention illustrating the movement of movable heaters shown in FIG. 1, the oven door not being shown in order to facilitate viewing of the movable heaters.
Figure 3:
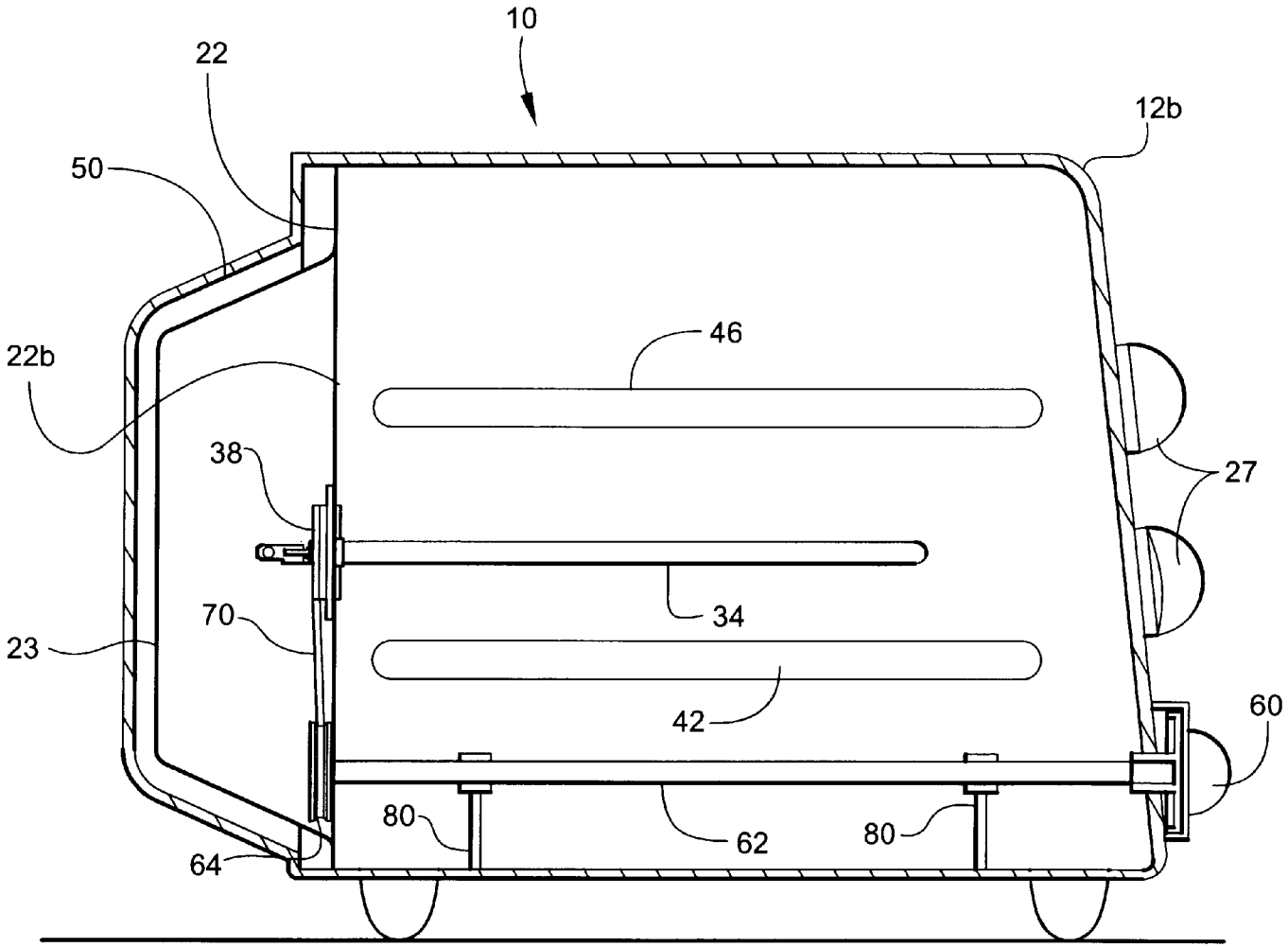
FIG. 3 is a cross-sectional view taken along line 3—3 of FIG. 2, the racks depicted in FIG. 2 not being shown in order to facilitate viewing of a manually operated mechanical drive system for moving the movable heaters.

Referring to FIGS. 1, 2 and 3, there is shown oven 10 of the present invention. Oven 10 generally comprises a panel members 12*a* and 12*b*, a top portion 14, a bottom portion 16, a pair of opposing sidewalls 18 and 20, a rear wall member 22 having a pair of end portions 22*a* and 22*b* and a protruding portion 23 between the end portions 22*a* and 22*b*. Oven 10 further includes an exterior panel 50. Exterior panel 50 has a shape that conforms to the shape of protruding portion 23 of rear wall member 22. As shown in FIG. 3, exterior panel 50 is fitted over protruding portion 23 of rear wall member 22. In one embodiment, exterior panel 50 is attached to the rear sides of panel members 12*a*, 12*b*, and top and bottom portions 14 and 16, respectively.

End portions 22*a* and 22*b* are generally perpendicular to sidewalls 18 and 20, respectively. The top portion 14, the bottom portion 16, the sidewalls 18 and 20 and the protruding portion 23 of rear wall member 22 define a heating or cooking chamber 24 for accommodating food to be cooked. Oven 10 further includes door 26 that is movably attached to housing 12. Oven 10 includes control knobs 27 for activating oven 10 and for setting a desired cooking time and cooking temperature.

Referring to FIGS. 1 and 2, oven 10 further comprises a first stationary heater 28 that is inside the cooking chamber 24 and positioned in the lower portion or region of cooking chamber 24 adjacent to the bottom portion 16. The oven 10 further comprises a second stationary heater 30 that is inside the cooking chamber 24 and positioned in the upper portion or region of cooking chamber 24 adjacent to the top portion 14. In one embodiment, the first and second stationary heaters 28 and 30 have a tubular configuration. Electrical power can be applied to heaters 28 and 30 by any one of variety of techniques well known in the art.

Referring to FIGS. 1 and 2, oven 10 further comprises a pair of movable heaters 32 and 34 located between the first and second stationary heaters 28 and 30. Movable heaters 32 and 34 are movably attached to the end portions 22*a* and 22*b*, respectively, of rear wall member 22 and movable, as indicated by arrows 35*a* and 35*b*, respectively, between a resting position and a heating position. In order to illustrate the resting position in FIG. 2, the movable heaters 32 and 34 are shown in phantom (i.e. dashed lines) and indicated by numerals 32*a* and 34*a*, respectively. When the movable heaters 32 and 34 are in the resting position, the movable heaters 32 and 34 are adjacent corresponding sidewalls 18 and 20, respectively.

Referring to FIG. 2, movable heaters 32 and 34 include the base members 36 and 38, respectively. The base members 36 and 38 are substantially circular in shape and rotatably attached to the end portions 22*a* and 22*b*, respectively, of rear wall member 22. Thus, movable heaters 32 and 34 are rotatably attached to the end portions 22*a* and 22*b*, respectively. In one embodiment, each movable heater 32 and 34 has a tubular configuration. In a preferred embodiment, each movable heater 32 and 34 has a substantially planar configuration. In such an embodiment, movable heaters 32 and 34 are substantially parallel to sidewalls 18 and 20, respectively, when the movable heaters 32 and 34 are in the resting position (see FIG. 2). In one embodiment, the movable heaters 32 and 34 are generally coplanar with each other when the movable heaters 32 and 34 are in the heating position, as shown in FIGS. 1 and 2. Such a configuration provides for uniform and consistent heating of the racks that are above and below the movable heaters 32 and 34 (the racks are discussed in the ensuing description).

As shown in FIG. 2, each movable heater 32 and 34 rotates about ninety (90) degrees when moving between the resting position and the heating position as indicated by arrows 35*a* and 35*b*, respectively. Movable heater 32 rotates in a clockwise direction when moving from the resting position to the heating position. The movable heater 34 rotates in a counter-clockwise direction when moving from the resting position to the heating position. The manually operated mechanical drive system for rotating movable heaters 32 and 34 is described in the ensuing description.

Oven 10 also includes electrical components and/or electromechanical components, not shown but known in the art, that automatically supply electrical power to the movable heaters 32 and 34 when these movable heaters are positioned in the heating position. The oven 10 further comprises additional electrical components and/or electromechanical components (not shown but well known in the art) that reduce the electrical power supplied to the first and second stationary heaters 28 and 30, respectively, when the movable heaters 32 and 34 are moved to the heating position. In one embodiment, the total power supplied to the stationary heaters 28 and 30, respectively, is about 1500 Watts when movable heaters 32 and 34 are in the resting position, and when the movable heaters 32 and 34 are rotated to the heating position, the power applied to the stationary heater 28 is about 400 Watts, the total power applied to the movable heaters 32 and 34 is about 400 Watts and the power supplied to the stationary heater 34 is about 350 Watts. However, it is to be understood that the aforementioned power ratings are just examples and that other suitable power ratings or combinations thereof can be used as well.

Referring to FIG. 1, oven 10 further includes a first pair of rack support members 40 and 42. Rack support members 40 and 42 are attached to sidewalls 18 and 20, respectively, so as to support a rack 43 within the cooking chamber 24 such that the rack 43 is below the movable heaters 32 and 34. Oven 10 also includes a second pair of rack support members 44 and 46. Rack support members 44 and 46 are attached to sidewalls 18 and 20, respectively, so as to support an additional rack 47 within the cooking chamber 24 such that the additional rack 47 is above the movable heaters 32 and 34.

Referring to FIG. 2, in a preferred embodiment, when rack 43 is supported by the rack support members 40 and 42, and rack 47 is supported by rack support members 44 and 46, and the movable heaters 32 and 34 are in the heating position, the movable heaters 32 and 34 are generally parallel to the racks, as shown in FIG. 2.

Figure 4:
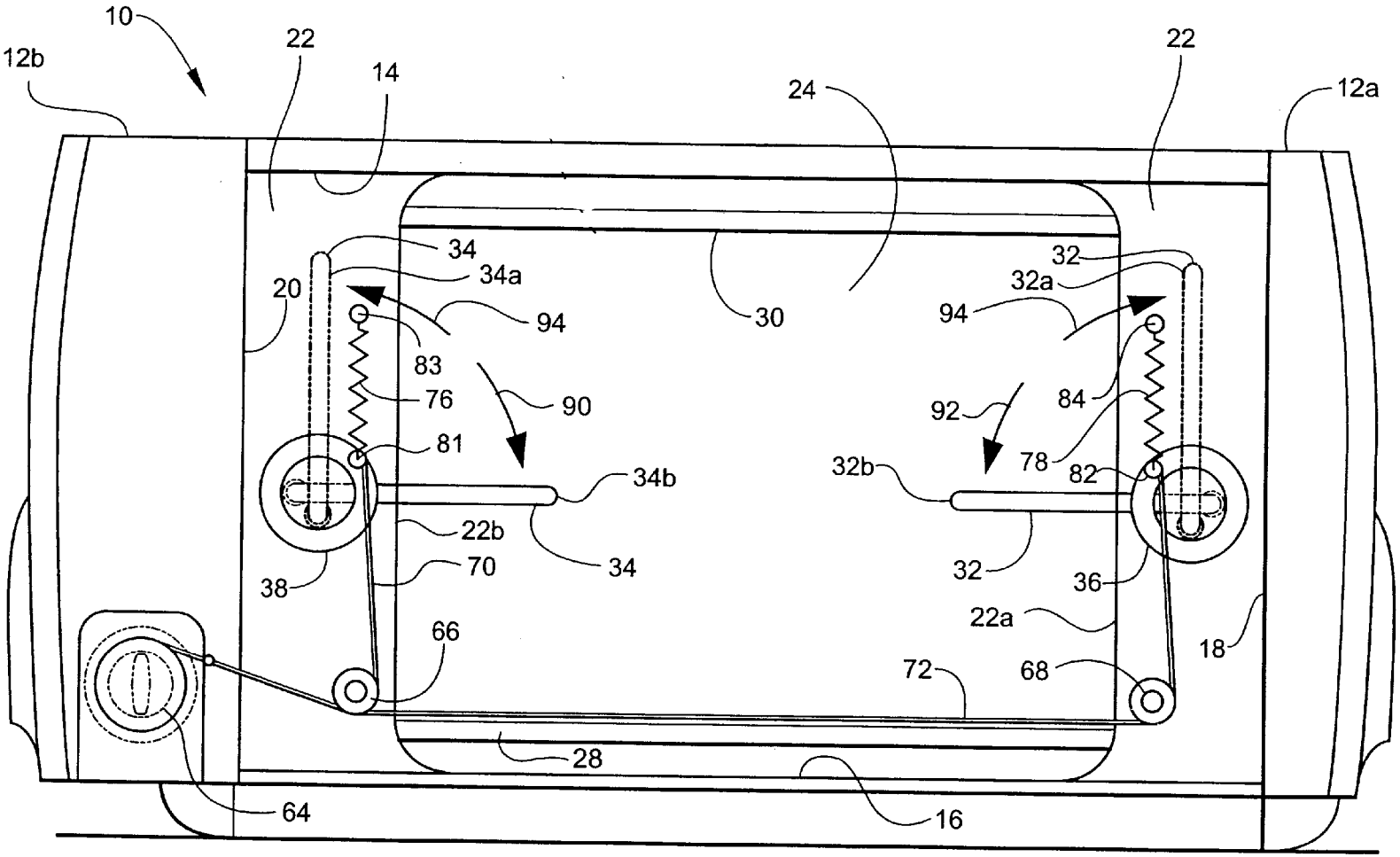
FIG. 4 is a rear view of the oven of the present invention, the exterior panel and protruding portion of the rear wall member, both of which being depicted in FIG. 3, not being shown so as to facilitate viewing of the manually operated mechanical drive system.

In accordance with the invention, the oven 10 further comprises a manually operated mechanical drive system that moves both movable heaters 32 and 34 simultaneously between the resting position and the heating position. Referring to FIGS. 2–4, exterior panel 50 covers and protects the mechanical drive system as well as the electrical interface components that provide electrical power to the movable heaters 32 and 34. Protruding portion 23 of rear wall member 22 and exterior panel 50 are not shown in FIG. 4 in order to facilitate viewing of the manually operated mechanical drive system. The manually operated mechanical drive system generally comprises knob 60, shaft 62 (shown in phantom), pulleys 64, 66 and 68, wires 70 and 72 and extension springs 76 and 78. Knob 60 is located on the front side of oven 10. Knob 60 is attached to the shaft 62. The shaft 62 extends along the width of oven 10 and is supported by vertical supports 80 which enable shaft 62 to rotate (see FIG. 3). The pulley 64 is attached to the end of the shaft 62. The pulleys 66 and 68 are rotatably attached to the end portions 22*b* and 22*a*, respectively, of rear wall member 22. The metal wire 70 is attached to the pulley 64, engaged with pulley 66 and is attached to the base member 38 via tab or fastener 81. The metal wire 72 is attached to the pulley 64, engaged with the pulleys 66 and 68, and is attached to the base member 36 via tab or fastener 82. Other suitable techniques for attaching wires 70 and 72 to base members 38 and 36, respectively, may be used as well.

It is to be understood that other suitable types of manually operated mechanical drive systems could be used to move movable heaters 32 and 34 between the resting position and the heating position. For example, such other suitable types of manually operated mechanical drive systems could utilize gears, ratchet wheels, shafts, chains, armatures, belts or various combinations thereof.

Referring to FIGS. 2–4, one end of extension spring 76 is attached to fastener 81 and the other end of extension spring 76 is attached to the end portion 22*b* via a fastener 83. The extension spring 76 urges the movable heater 34 (shown in phantom) to the resting position, indicated by numeral 34*a*. One end of extension spring 78 is attached to fastener 82 and the other end of extension spring 78 is attached to the end portion 22*a* via a fastener 84. Similarly, the extension spring 78 urges the movable heater 32 (shown in phantom) to the resting position, indicated by numeral 32*a*.

Referring to FIG. 4, when knob 60 is rotated ninety (90) degrees clockwise (when viewed from the front of oven 10), both movable heaters 32 and 34 are simultaneously moved to the heating position, indicated by numerals 32*b* and 34*b*, respectively. Specifically, when knob 60 is rotated ninety (90) degrees clockwise, wire 70 causes base member 38 to rotate clockwise, as indicated by arrow 90, thereby moving movable heater 34 to the heating position, and wire 72 causes base member 36 to rotate counter-clockwise as indicated by arrow 92, thereby moving movable heater 32 to the heating position. Knob 60 is configured to have a locking device (not shown) comprising a locking pin and a spring mounted on shaft 62 that locks knob 60 in position when knob 60 is fully rotated ninety (90) degrees clockwise. In order to move the movable heaters 32 and 34 back to the resting position, knob 60 is depressed, so as to release the locking device, and then rotated ninety (90) degrees counter-clockwise so as to allow extension springs 76 and 78 to rotate movable heaters 32 and 34 (indicated by arrows 94) back to the resting position. The configuration and locking device (not shown) of knob 60 is well known in the art and therefore, is not discussed in detail. It is to be understood that other suitable devices can be used to lock and release knob 60.

Thus, when a user desires to use oven 10 in a normal cooking mode, movable heaters 32 and 34 are left in the resting position and rack 43 is inserted into cooking chamber 24 and positioned upon rack support members 42 and 44. Rack 47 is not used in the normal cooking mode. If the user desires to configure oven 10 in the double-deck or double-rack configuration, the user rotates knob 60 ninety (90) degrees clockwise so as to move movable heaters 32 and 34 to the heating position and to lock knob 60 in place. The user then inserts upper rack 47 into cooking chamber 24 and positions rack 47 on rack support members 44 and 46. The user then uses knobs 27 to set the desired cooking time and cooking temperature.

Oven 10 has many advantages and benefits. Specifically, oven 10 can be easily and quickly converted from the normal, single-rack mode of operation, to the double-rack or double-deck mode of operation. Furthermore, the use of a manually operated mechanical drive system for moving the movable heaters 32 and 34 allows oven 10 to be manufactured at a relatively lower per-unit cost than prior art ovens utilizing electrical components and motors to move heaters. As a result, oven 10 is affordable to relatively more consumers in comparison to the aforementioned prior art ovens. Additionally, the manually operated mechanical drive system of oven 10 is energy efficient and as a result, reduces the total power consumption of oven 10.

Another important feature of oven 10 is protruding portion 23 of rear wall member 22 that allows relatively large-sized food items to be placed in the cooking chamber 24 as described in the foregoing description.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. An oven, comprising:

a cooking chamber having a pair of opposing sidewalls, and rear wall member having a pair of end portions, the cooking chamber having an upper portion and a lower portion;

a first stationary heater located within the lower portion of the cooking chamber;

a second stationary heater located within the upper portion of the cooking chamber;

a pair of movable heaters located between the first and second stationary heaters, each movable heater being movably attached to a corresponding one of end portions of the rear wall member and movable between a resting position and a heating position, each movable heater being adjacent to a corresponding sidewall when the movable heater is in the resting position;

a manually operated mechanical drive system for moving both movable heaters simultaneously between the resting position and the heating position;

a first pair of rack support members, each rack support member being attached to a corresponding one of the opposed sidewalls so as to support a rack within the cooking chamber such that the rack is below the movable heaters; and a second pair of rack support members, each rack support member of the second pair being attached to a corresponding one of the opposed sidewalls so as to support an additional rack within the cooking chamber such that the additional rack is above the movable heaters.

2. The oven according to claim 1 wherein each movable heater is rotatably attached to the corresponding one of end portions of the rear wall member.

3. The oven according to claim 1 wherein each movable heater is substantially planar.

4. The oven according to claim 3 wherein each movable heater is substantially parallel to a corresponding sidewall when the movable heater is in the resting position.

5. The oven according to claim 3 wherein the movable heaters are generally coplanar with each other when in the heating position.

6. The oven according to claim 2 wherein each movable heater rotates about ninety (90) degrees when moving from the resting position to the heating position.

7. The oven according to claim 2 wherein one movable heater rotates in a clockwise direction when moving from the resting position to the heating position, and the other movable heater rotates in a counter-clockwise direction when moving from the resting position to the heating position.

8. The oven according to claim 1 wherein the rear wall member has a protruding portion between the end portions, the protruding portion forming part of the cooking chamber.

9. The oven according to claim 1 wherein when racks are supported by the first and second pairs of rack support members and the movable heaters are in the heating position, the movable heaters are generally parallel to the racks.

10. An oven, comprising:

a cooking chamber comprising a pair of opposing sidewalls, and a rear wall member, the rear wall member having a pair of end portions, each end portion being generally perpendicular to the opposing sidewalls, the cooking chamber having an upper portion and a lower portion;

a first stationary heater located within the lower portion of the cooking chamber;

a second stationary heater located within the upper portion of the cooking chamber;

a pair of movable heaters located between the first and second stationary heaters, each movable heater being movably attached to a corresponding one of the end portions of the rear wall member and movable between a resting position and a heating position, each movable heater being adjacent to a corresponding sidewall when the movable heater is in the resting position;

a manually operated mechanical drive system for moving both movable heaters simultaneously between the resting position and the heating position;

a first pair of rack support members, each rack support member being attached to a corresponding one of the opposed sidewalls so as to support a rack within the cooking chamber such that the rack is below the movable heaters; and a second pair of rack support members, each rack support member of the second pair being attached to a corresponding one of the opposed sidewalls so as to support an additional rack within the cooking chamber such that the additional rack is above the movable heaters.

11. An oven, comprising:

a cooking chamber comprising a pair of opposing sidewalls, and a rear wall member, the rear wall member having a pair of end portions and a protruding portion between the end portions, each end portion being generally perpendicular to the opposing sidewalls, the protruding portion forming a portion of the cooking chamber, the cooking chamber having an upper portion and a lower portion;

a first stationary heater located within the lower portion of the cooking chamber;

a second stationary heater located within the upper portion of the cooking chamber;

a pair of movable heaters located between the first and second stationary heaters, each movable heater being movably attached to a corresponding one of the end portions of the rear wall member and movable between a resting position and a heating position, each movable heater being adjacent to a corresponding sidewall when the movable heater is in the resting position;

means for moving both movable heaters simultaneously between the resting position and the heating position;

a first pair of rack support members, each rack support member being attached to a corresponding one of the opposed sidewalls so as to support a rack within the cooking chamber such that the rack is below the movable heaters; and a second pair of rack support members, each rack support member of the second pair being attached to a corresponding one of the opposed sidewalls so as to support an additional rack within the cooking chamber such that the additional rack is above the movable heaters.

* * * * *